US007017201B2

(12) United States Patent
Lin

(10) Patent No.: US 7,017,201 B2
(45) Date of Patent: Mar. 28, 2006

(54) TABLE STRUCTURE WHICH CAN BE CONVERTED INTO A BED

(76) Inventor: Yu-Ting Lin, No. 43-1, Min Chiuan Rd., Shen Gang Hsiang, Taichung Hsien (TW)

( * ) Notice: Subject to any disclaimer, the term of this patent is extended or adjusted under 35 U.S.C. 154(b) by 236 days.

(21) Appl. No.: 10/759,368

(22) Filed: Jan. 15, 2004

(65) Prior Publication Data

US 2005/0155148 A1 Jul. 21, 2005

(51) Int. Cl.
*A47C 13/38* (2006.01)

(52) U.S. Cl. ..... 5/3; 5/2.1; 5/5
(58) Field of Classification Search ..... 5/3–8, 5/9.1, 2.1, 1
See application file for complete search history.

(56) References Cited

U.S. PATENT DOCUMENTS 3,113,324 A * 12/1963 Kamp et al. ..... 5/3
6,167,579 B1 * 1/2001 Kopish ..... 5/2.1

* cited by examiner

*Primary Examiner*—Michael F. Trettel
*Assistant Examiner*—Fredrick Conley
(74) *Attorney, Agent, or Firm*—Charles E. Baxley

(57) ABSTRACT

The present invention relates to a table structure that can be converted into bed or table according to user's needs. Wherein a base frame of the present invention is respectively provided with a bed having two L-shape side frames and a table having two side shelves. The two side shelves of the table are connected to the base frame through spiral arms, by virtue of the pivotal connection between the L-shape side frames and the side shelves, the bed can be positioned respectively in a horizontal manner or in a vertical manner. Through the spiral arms, the table can be lowered down or raised up relative to the bed, such that the device of the present invention can be converted into a bed or a table as desired.

6 Claims, 6 Drawing Sheets

TABLE STRUCTURE WHICH CAN BE CONVERTED INTO A BED

BACKGROUND OF THE INVENTION

1. Field of the Invention

The present invention relates to a table structure, and more particularly to a table structure that can be converted into a bed or a table according to user's needs, such that much space can be substantially saved.

2. Description of the Prior Arts

Table and bed are daily necessities, however conventional table and bed always occupy a lot of space. In this case, some beds or tables that relatively occupying less space have been developed, however, in fact it still occupies space.

The present invention has arisen to mitigate and/or obviate the afore-described disadvantages of the conventional table or bed.

SUMMARY OF THE INVENTION

The primary object of the present invention is to provide a table structure that can be converted into a bed or a table according to user's needs. Wherein a base frame of the present invention is provided with a bed having two L-shape side frames and a table having two side shelves respectively. The two side shelves of the table are connected to the base frame through spiral arms, by virtue of the pivotal connection between the L-shape side frames and the side shelves, the bed can be positioned in A horizontal manner or in a vertical manner. Through the spiral arms, the table can be lowered down or raised up relative to the bed, such that the device of the present invention can be converted into a bed or a table as desired.

The present invention will become more obvious from the following description when taken in connection with the accompanying drawings, which shows, for purpose of illustrations only, the preferred embodiment in accordance with the present invention.

BRIEF DESCRIPITION OF THE DRAWINGS

DETAILED DESCRIPTION OF THE PREFERRED EMBODIMENT

Figure 1:
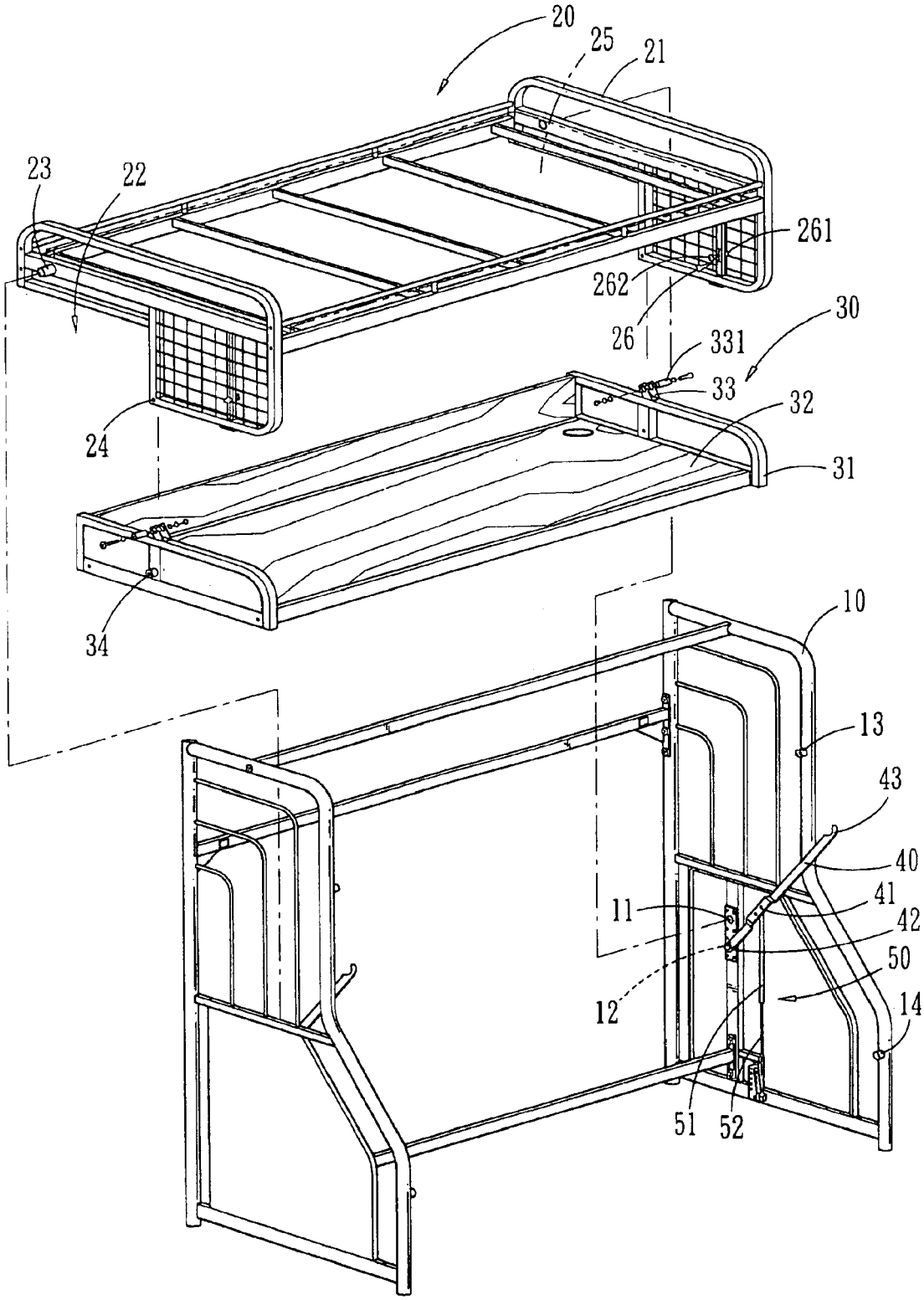
FIG. 1 is an exploded view of a table structure that can be converted into a bed in accordance with the present invention.
Figure 2:
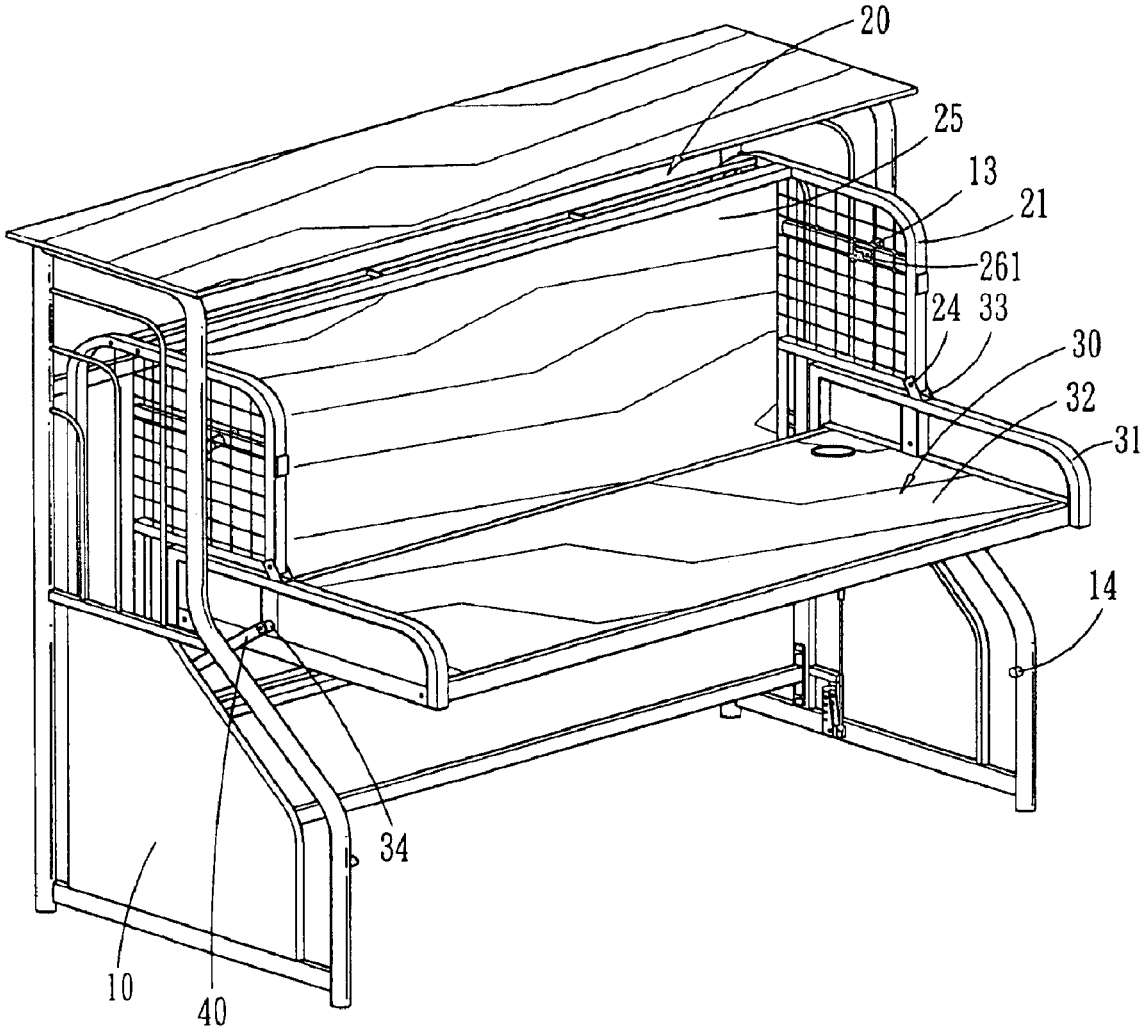
FIG. 2 is an assembly view of the a table structure in accordance with the present invention that has been converted into a table.

Referring to FIGS. 1 and 2, wherein a table structure that can be converted into a bed in accordance with a embodiment of the present invention is shown and generally comprised of: a base frame 10, a bed 20, a table 30, two spiral arms 40 and two retractable rods 50.

The base frame 10 serves to stand firmly on the ground, at both sides of the base frame 10 are defined with a first hole 11 and a second hole 12 respectively. The first hole 11 is located vertically above the second hole 12. The base frame 10 is further provided at both sides thereof with an upper locating pipe 13 and a lower locating pipe 14 respectively.

The bed 20 includes two L-shape side frames 21 and a board 25. The L-shape side frames 21 each has a mouth 22 corresponding to the base frame 10. Both of the L-shape side frames 21 are further provided at an end adjacent to the base frame 10 with a pivot 23 for insertion into the first hole 11 at both sides of the base frame 10, such that the bed 20 can be positioned firmly between both sides of the base frame 10. At another end of the L-shape side frames 21 is defined with a connecting hole 24 respectively and the connecting hole 24 is located close to the mouth 22. In addition, a locking unit 26 is provided respectively on the L-shape side frames 21, and with a help of a predetermined elastic force, a locating pivot 261 is slidably disposed on the locking unit 26. The locating pivot 261 has a pull portion 262 defined at an end thereof, while another protrusive end of the locating pivot 261 corresponds to the upper and the lower locating pipes 13, 14 at both sides of the base frame 10, which can be inserted in the upper or the lower locating pipes 13,14 according to the position of the bed 20.

The table 30 comprises two side shelves 31 and a board 32. The side shelves 31 each provided at an upper position of a center thereof with a mounting seat 33 serving to connect to the connecting hole 24 of the L-shape side frames 21 of the bed 20 by incorporating with a pin 331. A side of the both side shelves 31 of the table 30 corresponds to a side surface of the mouth 22 of the L-shape side frames 21. Each of the side shelves 31 is further provided at a lower position of the center thereof, vertically under the mounting seat 33, with a spiral pin 34.

The spiral arms 40, each of which has an end locked in the second hole 12 of the base frame 10 through a connecting member 42, and another end of the each spiral arms 40 is defined with a hook 43. Each of the spiral arms 40 is further provided with a mounting portion at the center thereof. The hook 43 is positioned on the spiral pin 34 at both side shelves 31 of the table 30.

The retractable rods 50, each of which is comprised of an outer pipe 51 and an inner pipe 52 (such as oil pressure retractable rod, air pressure retractable rod, elastic rod respectively provided with predetermined oil/air pressure or springs). An upper end of the retractable rods 50 connects to the mounting portion 41 of the spiral arms 40, and a lower end of the retractable rods 50 is positioned on internal surface of the base frame 10.

Figure 3:
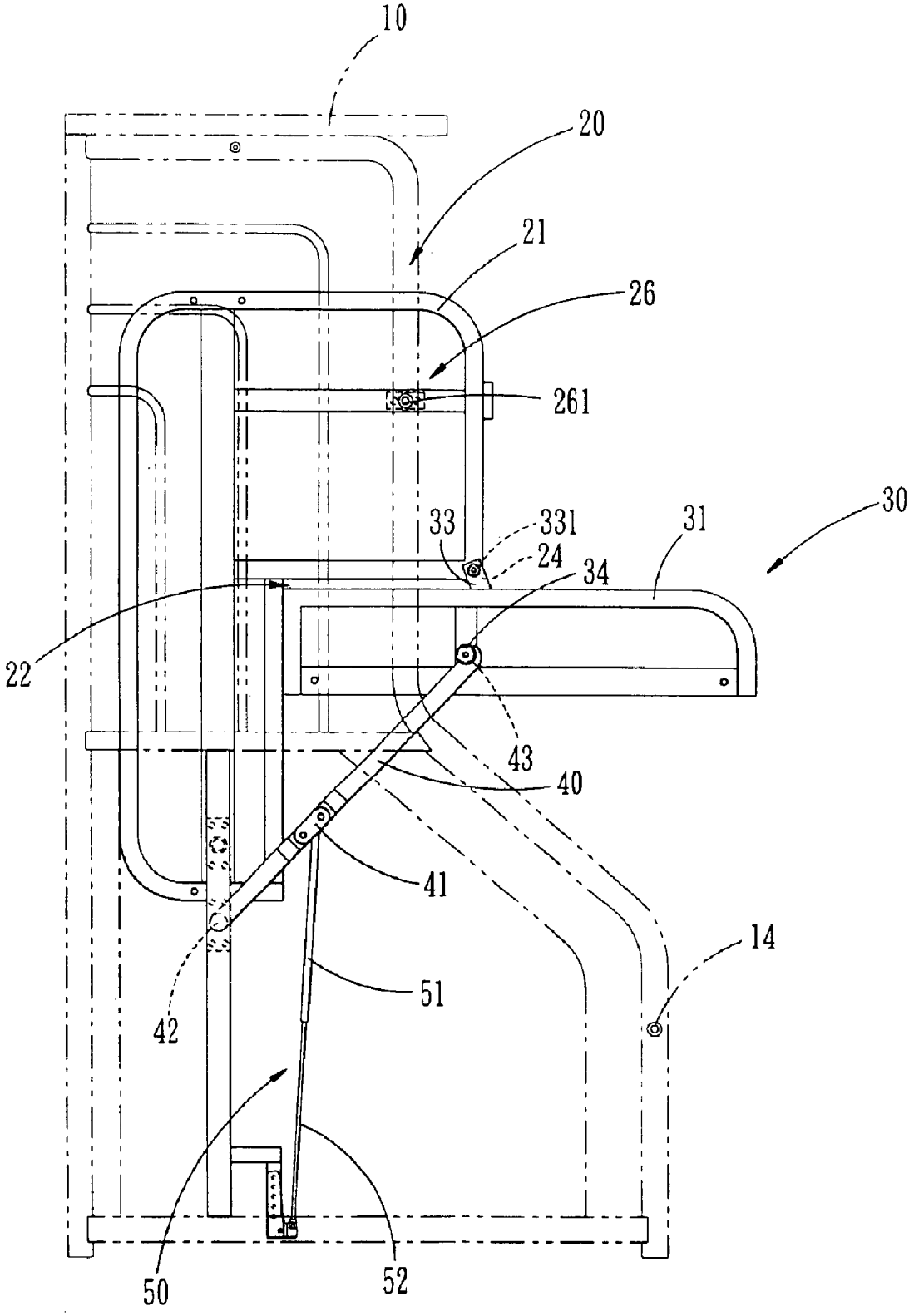
FIG. 3 is a side illustrative view of the table structure FIG. 2.

Referring further to FIGS. 2–5, when the device of the present invention needs to be used as a table (as shown in FIGS. 2 and 3), the bed 20 is rotated 90 degrees by taking advantage of the pivot 23 at both sides thereof and the first hole 11 of the base frame 10 (toward the direction of mouth 22). And the board 25 of the bed 20 stands vertically after rotation. At this moment, the mounting seat 33 at both sides of table 30 is connected to the connecting hole 24 of the L-shape side frames 21 of the bed 20, therefore, the bed 30 will be raised upward in a circular motion during the rotation of the bed 20. In this case, the user can raise the table 30 in a circular motion with the help of the spiral arms 40, and the table can be raised steadily in a horizontal manner supported by the spiral arms 40 and the retractable rods 50. After the board 25 of the bed 20 is rotated from horizontal position to a vertical position, the bed 20 and the table 30 are positioned stably on the base frame 10 in the form of a table (after the bed 20 and the table 30 are positioned in place, they can be re-locked and positioned more firmly by some additional locking members). The side surface of the mouth 22 of the L-shape side frames 21 of the bed 20 still firmly abuts against the side of the side shelves 31 of the table 30, while the side shelves 31 of the table 30 right insert in the mouth 22 of the bed 20. The board 25 of the bed 20 is rotated from vertical position to a horizontal position.

Figure 4:
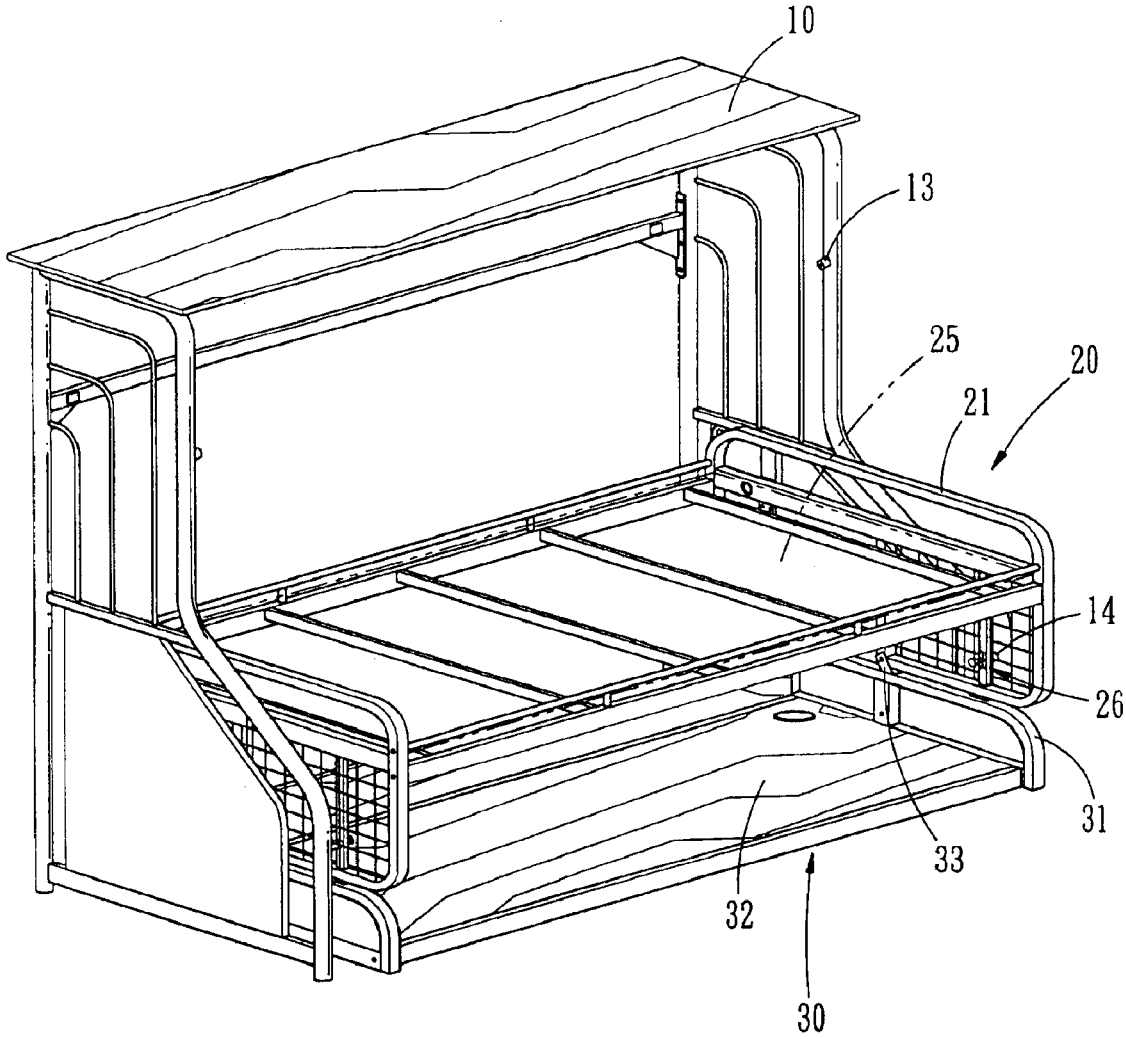
FIG. 4 is an assembly view of the a table structure in accordance with the present invention that has been converted into a table.
Figure 5:
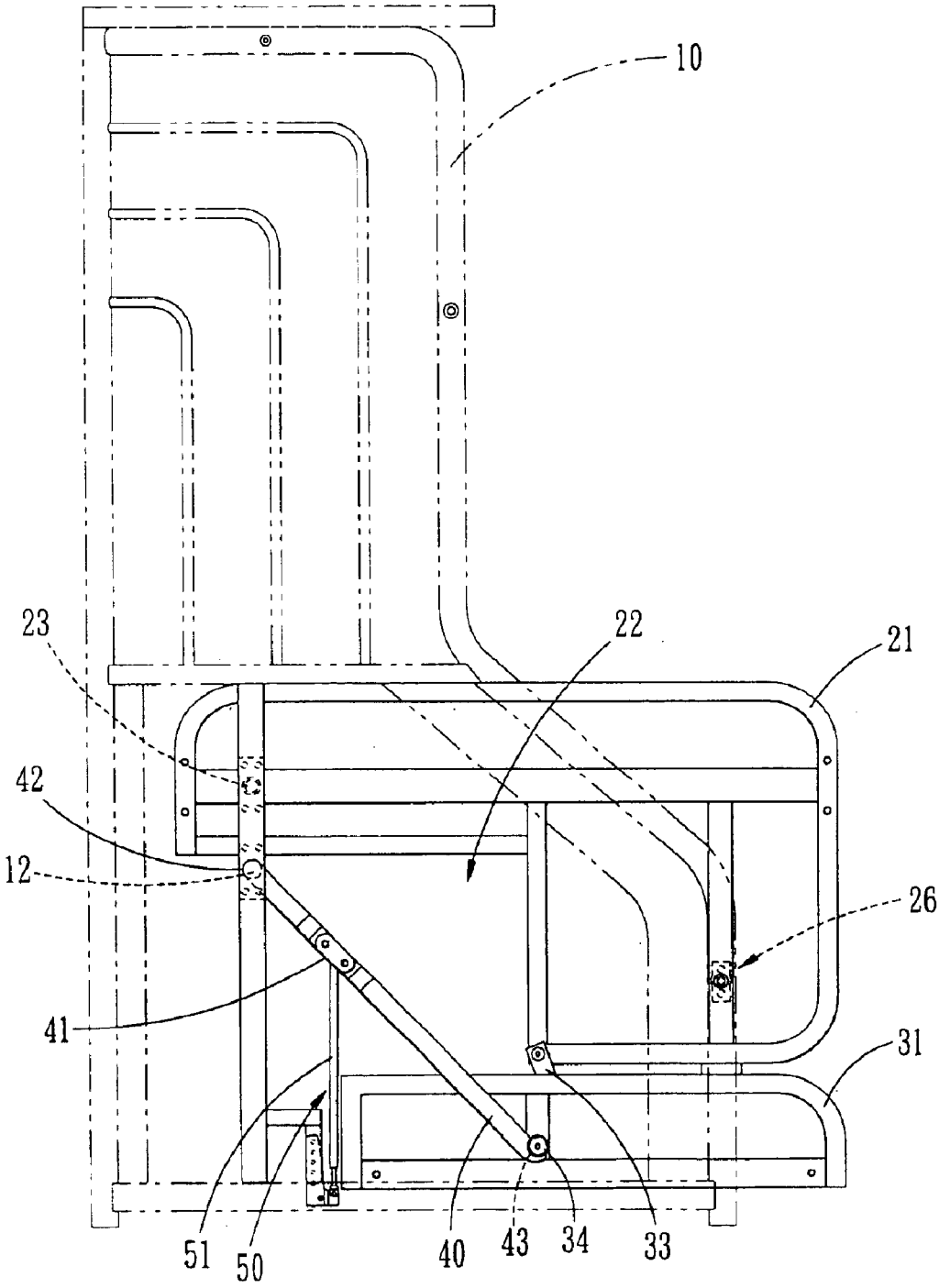
FIG. 5 is a side illustrative view of the table structure FIG. 4.

On the other hand, when the device of the present invention needs to converted into a bed (as shown in FIGS. 4 and 5), the user can release the additional locking members (conventional locking members), and then re-rotates the bed 20 90 degrees (opposite the direction of the mouth). The board 25 of the bed 20 is rotated from vertical position to a horizontal position. At this moment, the mounting seat 33 at both sides of table 30 is connected to the connecting hole 24 of the L-shape side frames 21 of the bed 20, therefore, the bed 30 will be lowered down in a circular motion along with the rotation of the bed 20. In this case, the table 30 can be lowered downward in a circular motion by incorporating with the spiral arms 40, and the table can be lowered steadily down in a horizontal manner with the support of the spiral arms 40 and the retractable rods 50. After the board 25 of the bed 20 is rotated from vertical position to horizontal position, the bed 20 and the table 30 are horizontally positioned. And some locking members can be additionally provided for further positioning the respective parts of the present invention. Another side surface of the mouth 22 of the L-shape side frames 21 of the bed 20 still firmly abuts against the side of the side shelves 31 of the table 30, such that the side shelves 31 of the table 30 are converted into bearing foot of the L-shape side frames 21 of the bed 20. Thereby, the device of the present invention can be easily converted into a bed.

Figure 6:
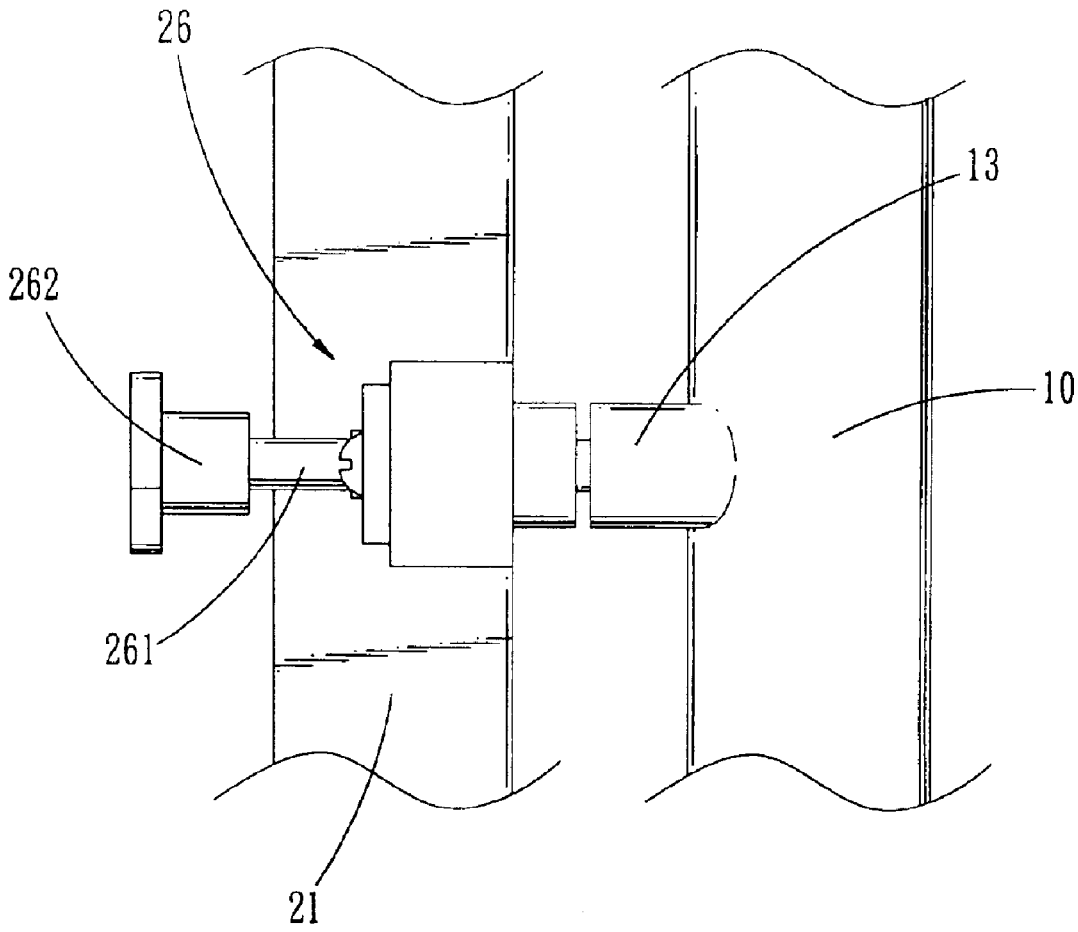
FIG. 6 is a partial amplified view of a locking unit of the table structure in accordance with the present invention.

It is to be noted that, as shown in FIG. 6, the bed 20 and the table 30 can be additionally provided with locking unit 26, the protrusive end of the locating pivot 26 is driven by the predetermined elastic force of the locking unit 26 to insert in the upper or the lower locating pipes 13, 14 according to the position of the bed 20, such that the device of the present invention can be positioned stably. In addition, the retractable rods 50 can be in form of the oil/air pressure type, and elastic type, and the retractable rods 50 are provided with predetermined oil/air pressure and elastic force serving as supporting force, or serving as auxiliary force to lower or raise the board.

While we have shown and described various embodiments in accordance with the present invention, it should be clear to those skilled in the art that further embodiments may be made without departing from the scope of the present invention.

What is claimed is:

1. A table structure which can be converted into a bed, comprising:

a base frame serving to stand firmly on the ground;

a bed including two L-shape side frames and a board, the two L-shape side frames each having a mouth defined corresponding to the base frame and the two L-shape side frames connected to the base frame;

a table having two side shelves and a board, each of the side shelves having a center coupled to the L-shape side frames, the side shelves of the table corresponding to the mouth of the two L-shape side frames, a spiral pin provided under the center of the side shelves;

two spiral arms, each of which having an end locked to the base frame and having another end defined with a hook, the hook positioned on the spiral pin at the both side shelves of the spiral pin.

2. The table structure which can be converted into a bed as claimed in claim 1, comprises a base frame, a bed, a table, two spiral arms and two retractable rods, wherein the base frame, on both side surfaces of which is defined with a first hole and a second hole, the first hole is located vertically above the second hole, the bed, both of the L-shape side frames are further provided at an end adjacent to the base frame with a pivot for insertion into the first hole at both sides of the base frame, such that the bed can be positioned firmly between both sides of the base frame, at another end of the L-shape side frames is defined with a connecting hole and the connecting hole is located close to the mouth;

the table, the side shelves of which are provided with a mounting seat at an upper portion of the center thereof, the mounting seat is connected to the connecting hole of the L-shape side frames through a pin, a side of the both side shelves of the table corresponds to a side surface of the mouth of the L-shape side frames, the spiral pin is located vertically under the mounting seat;

the spiral arms, each of which is defined with a mounting portion at a center thereof;

the retractable rods each has an upper end connected to the mounting portion of the spiral arms and has a lower end positioned on the base frame.

3. The table structure which can be converted into a bed as claimed in claim 2, wherein the retractable rods can be in form of oil pressure rod, which includes an outer pipe, an inner pipe and provided with oil pressure.

4. The table structure which can be converted into a bed as claimed in claim 2, wherein the retractable rods can be in form of air pressure rod, which includes an outer pipe, an inner pipe and provided with air pressure.

5. The table structure which can be converted into a bed as claimed in claim 2, wherein the retractable rods can be in form of elastic rod, which includes an outer pipe, an inner pipe and provided with springs.

6. The table structure which can be converted into a bed as claimed in claim 2, wherein an upper locating pipe and a lower locating pipe are provided on both sides of the base frame, a locking unit is provided on the L-shape side frames of the bed, and with a help of a predetermined elastic force, a locating pivot is slidably disposed on the locking unit, the locating pivot has a pull portion defined at an end thereof, another protrusive end of the locating pivot serves to be inserted into the upper or the lower locating pipes as desired.

* * * * *